US010612798B2

(12) United States Patent
Wong

(10) Patent No.: US 10,612,798 B2
(45) Date of Patent: Apr. 7, 2020

(54) AIR CONDITIONING AND HEAT PUMP TOWER WITH ENERGY EFFICIENT ARRANGEMENT

(71) Applicant: Lee Wa Wong, Pico Rivera, CA (US)

(72) Inventor: Lee Wa Wong, Pico Rivera, CA (US)

( * ) Notice: Subject to any disclaimer, the term of this patent is extended or adjusted under 35 U.S.C. 154(b) by 616 days.

(21) Appl. No.: 15/144,442

(22) Filed: May 2, 2016

(65) Prior Publication Data

US 2017/0314795 A1 Nov. 2, 2017

(51) Int. Cl.

| | |
|---|---|
| ***F24F 3/00*** | (2006.01) |
| ***F25B 13/00*** | (2006.01) |
| ***F25B 41/04*** | (2006.01) |
| ***F25B 49/02*** | (2006.01) |

(52) U.S. Cl.

CPC ..... *F24F 3/001* (2013.01); *F25B 13/00* (2013.01); *F25B 41/046* (2013.01); *F25B 49/02* (2013.01); *F25B 2313/02321* (2013.01); *F25B 2313/02344* (2013.01); *F25B 2341/0662* (2013.01); *F25B 2400/071* (2013.01)

(58) Field of Classification Search

CPC ..... F24F 1/02; F24F 3/001; F24F 2001/0051; F24F 2001/0055; F24F 2001/0048; F24F 1/022; F25B 2400/01; F25B 2313/008; Y02B 30/563

USPC ..... 62/238.7, 324.1

See application file for complete search history.

(56) References Cited

U.S. PATENT DOCUMENTS

| | | | | |
|---|---|---|---|---|
| 3,589,437 | A | 6/1971 | Shoji et al. | |
| 2002/0032985 | A1 * | 3/2002 | Kim | F24F 1/0011 49/74.1 |
| 2007/0039343 | A1 | 2/2007 | Ikegami et al. | |
| 2008/0156891 | A1 * | 7/2008 | Zhou | F24F 1/027 236/44 C |
| 2017/0191715 | A1 * | 7/2017 | Yang | F24F 3/147 |

FOREIGN PATENT DOCUMENTS

| | | | | |
|---|---|---|---|---|
| EP | 1321727 | A2 * | 6/2003 | F25B 13/00 |
| GB | 2177497 | A | 1/1987 | |
| JP | S62-26428 | A | 2/1987 | |
| JP | 2006200869 | A * | 8/2006 | |

* cited by examiner

*Primary Examiner* — Jianying C Atkisson
*Assistant Examiner* — Meraj A Shaikh
(74) *Attorney, Agent, or Firm* — Tsz Lung Yeung

(57) ABSTRACT

An air conditioning and heat pump tower includes a main casing, a plurality of connecting pipes, a compressor, a front heat exchanger, a rear heat exchanger, a fan unit, and an energy efficient arrangement. The energy efficient arrangement includes a first pre-heating heat exchanger supported in a front compartment of the main casing, and positioned between an outdoor air intake opening and an outdoor heat exchanging portion of the front heat exchanger. The air conditioning and heat pump tower may be operated between an air conditioning mode for absorbing heat from the indoor space, and a heat pump mode for producing heat to the indoor space. A predetermined amount of ambient air may be drawn through the outdoor air intake opening and may be pre-heated by the energy efficient arrangement before delivering to the indoor space.

21 Claims, 10 Drawing Sheets

AIR CONDITIONING AND HEAT PUMP TOWER WITH ENERGY EFFICIENT ARRANGEMENT

BACKGROUND OF THE PRESENT INVENTION

Field of Invention

The present invention relates to an air conditioning and heat pump tower which comprises an energy efficient arrangement configured to save a substantial amount of energy when the air conditioning and heat pump system is being operated in a heat pump mode.

Description of Related Arts

Conventional air conditioning and heat pump systems may be broadly divided into two main types. The first type is air conditioning and heat pump systems which are arranged to directly heat up or cool down the air of an indoor space. An example of the first type is window-type air conditioning and/or heat pump units, which controllably suck air from the indoor space and directly heat up or cool down the air. After the air has been heated or cooled, it is delivered back to the indoor space. The second type is central air conditioning heat pump systems in which a heat exchange medium (usually water) may be used to heat up or cool down air in the indoor space.

Referring to FIG. 1 of the drawings, a schematic diagram illustrating a refrigerant flowing path of a conventional air conditioning and heat pump system is shown. The conventional air conditioning and heat pump system 1P usually comprises a compressor 11P, a front heat exchanger 12P, a rear heat exchanger 13P, a four-way valve 14P, a first unidirectional valve 151P, a second unidirectional valve 152P, a first expansion valve 161P, a second expansion valve 162P, a first filter device 171P, and a second filter device 172P.

The first unidirectional valve 151P, the first expansion valve 161P and the first filter device 171P are connected in series in Path 1. The second unidirectional valve 152P, the second expansion valve 162P, and the second filter device 172P are connected in series in Path 2. The components in Path 1 and the components in Path 2 are connected in parallel. These components are connected between the front heat exchanger 12P and the rear heat exchanger 13P.

The four-way valve 14P has a first through fourth communicative port 141P, 142P, 143P, 144P, and may be operated in an air conditioning switching mode and a heat pump switching mode, wherein in the air conditioning switching mode, the first communicative port 141P is connected to the second communicative port 142P, while the third communicative port 143P is connected to the fourth communicative port 144P. In the heat pump switching mode, the first communicative port 141P may be connected to the third communicative port 143P while the second communicative port 142P is connected to the fourth communicative port 144P.

The refrigerant circulating in the conventional air conditioning and heat pump system is arranged to absorb heat from ambient air and release heat directly to the indoor space. When the air conditioning and heat pump system operates as an air conditioning system, superheated or vaporous refrigerant leaves the compressor 11P and passes through the first communicative port 141P, the second communicative port 142P, and rear heat exchanger 13P (for releasing heat to ambient air), the components connected in Path 2, the front heat exchanger 12P (for absorbing heat from the indoor space), the third communicative port 143P, the fourth communicative port 144P, and goes back to the compressor 11P.

When the air conditioning and heat pump system operates as a heat pump, superheated or vaporous refrigerant leaves the compressor 11P and passes through the first communicative port 141P, the third communicative port 143P, and front heat exchanger 12P (for releasing heat to the indoor space), the components connected in Path 1, the rear heat exchanger 13P (for absorbing heat from ambient air), the second communicative port 142P, the fourth communicative port 144P, and goes back to the compressor 11P.

Although the above-mentioned air conditioning and heat pump systems have widely been utilized around the world for many years, these systems suffer a common deficiency of a relatively low Coefficient of Performance (COP), which may be defined as a ratio of heat supplied to or removed from a reservoir to the work required.

Accordingly, there is a need to develop an air conditioning and heat pump system which has substantially improved COP.

SUMMARY OF THE PRESENT INVENTION

Certain variations of the present invention provide an air conditioning and heat pump tower which comprises an energy efficient arrangement configured to save a substantial amount of energy when the air conditioning and heat pump system is being operated in a heat pump mode.

Certain variations of the present invention provide an air conditioning and heat pump tower which comprises an energy efficient arrangement configured to pre-heat ambient air before it is delivered to an indoor space.

Certain variations of the present invention provide an air conditioning and heat pump tower which is capable of producing more heat to designated indoor space for a given work done by the system as compared with conventional air conditioning and heat pump system as described above.

In one aspect of the present invention, the present invention provides an air conditioning and heat pump tower being position at an opening of a wall which creates an indoor space and an outdoor space on two sides of the wall, the air conditioning and heat pump tower comprising:

a main casing comprising a partitioning wall, and having:

an indoor portion exposed to the indoor space;

an outdoor portion exposed to the outdoor space;

a receiving cavity formed in the main casing, the partitioning wall dividing the receiving cavity into a front compartment and a rear compartment;

an indoor air inlet being formed on the indoor portion of the main casing, and communicating the front compartment with the indoor space;

an indoor air outlet being formed on the indoor portion of the main casing, and communicating the front compartment with the indoor space;

an outdoor air inlet being formed on the outdoor portion of the main casing, and communicating the rear compartment with the outdoor space;

an outdoor air outlet being formed on the outdoor portion of the main casing, and communicating the rear compartment with the outdoor space; and at least one outdoor air intake opening being formed on the outdoor portion of the main casing, and communicating the front compartment with the outdoor space;

a plurality of connecting pipes received in the receiving cavity of the main casing;

a compressor supported in the main casing, the compressor having a compressor outlet and a compressor inlet;

a front heat exchanger supported in the front compartment of the main casing and connected to the compressor through at least one of the connecting pipes, the front heat exchanger has an indoor heat exchanging portion extending in the indoor portion of the main casing, and an outdoor heat exchanging portion extending in the outdoor portion of the main casing; and a rear heat exchanger supported in the rear compartment of the main casing and connected to the compressor and the front heat exchanger through at least one of the connecting pipes;

a fan unit supported in the main casing for drawing air to flow between the indoor space and the outdoor space; and an energy efficient arrangement, which comprises:

a first pre-heating heat exchanger supported in the front compartment of the receiving cavity at an outdoor portion of the main casing, the first pre-heating heat exchanger being positioned between the air intake opening and the outdoor heat exchanging portion of the front heat exchanger and connected between the front heat exchanger and the rear heat exchanger;

the air conditioning and heat pump tower being selectively operated between an air conditioning mode and a heat pump mode, wherein in the air conditioning mode, a predetermined amount of vaporous refrigerant is arranged to leave the compressor and guided to enter the rear heat exchanger for releasing heat to ambient atmosphere, the refrigerant leaving the rear heat exchanger being guided to flow into the front heat exchanger for absorbing heat from the indoor space, the refrigerant leaving the front heat exchanger being guided to flow back to the compressor to complete an air conditioning cycle, wherein in the heat pump mode, a predetermined amount of vaporous refrigerant is arranged to leave the compressor and guided to flow into the front heat exchanger for releasing heat to the indoor space, the refrigerant leaving the first main heat exchanger being guided to flow into the first pre-heating heat exchanger for releasing heat to ambient air drawn from the outdoor air intake opening, the refrigerant leaving the first pre-heating heat exchanger being guided to flow into the rear heat exchanger for absorbing heat from ambient air drawn from the outdoor air inlet, the refrigerant leaving the rear heat exchanger being guided to flow to back the compressor to complete a heat pump cycle.

DETAILED DESCRIPTION OF THE PREFERRED EMBODIMENT

Figure 1:
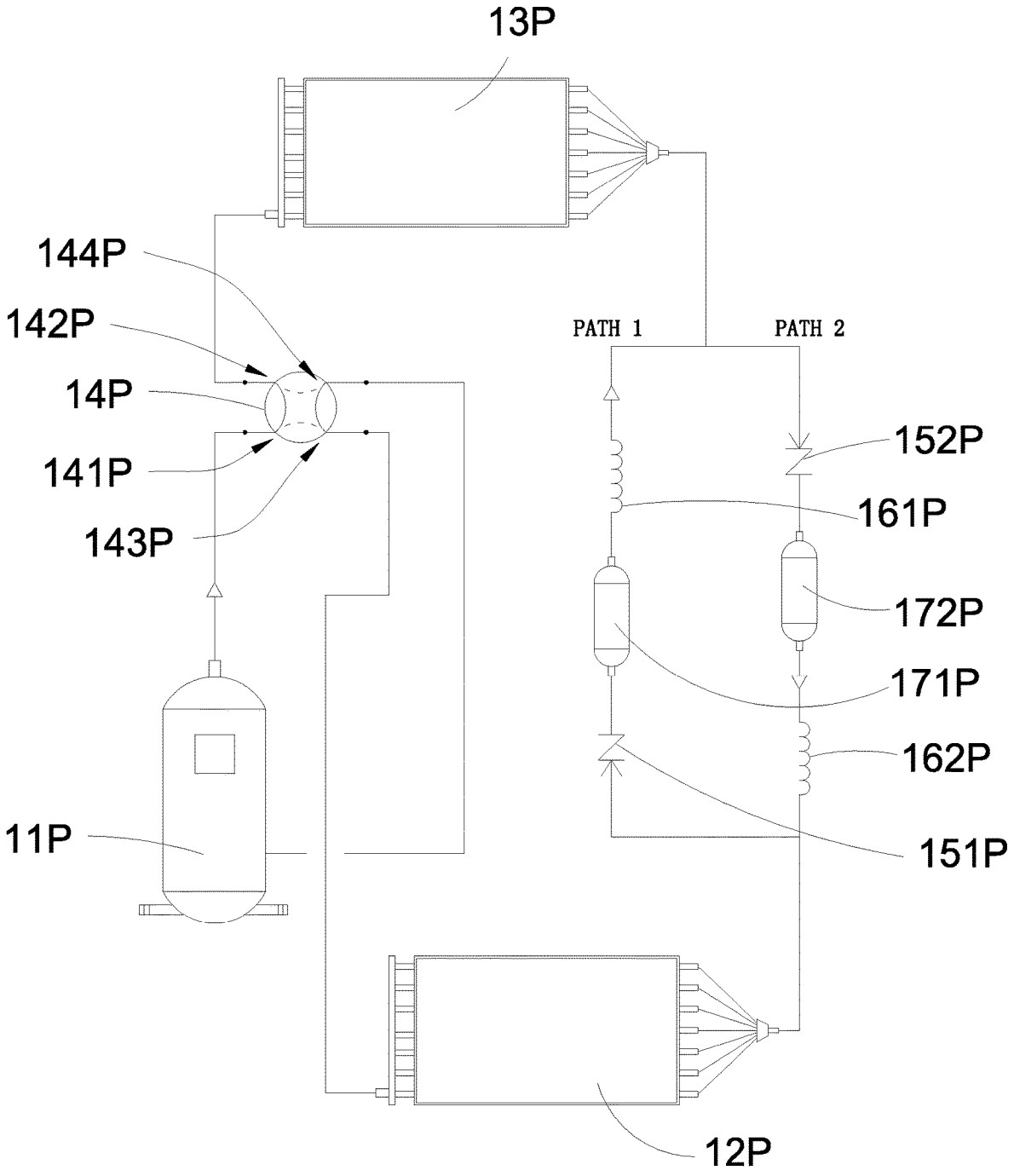
FIG. 1 PRIOR ART
FIG. 1 is a schematic diagram illustrating the refrigerant flowing path of a conventional air conditioning and heat pump system.

The following detailed description of the preferred embodiment is the preferred mode of carrying out the invention. The description is not to be taken in any limiting sense. It is presented for the purpose of illustrating the general principles of the present invention.

Referring to FIG. 2 to FIG. 6 of the drawings, an air conditioning and heat pump tower according to a first preferred embodiment of the present invention is illustrated. Broadly, the air conditioning and heat pump tower may comprise a main casing 10, a plurality of connecting pipes 20, a compressor 30, a front heat exchanger 40, at least one rear heat exchanger 50, a fan unit 60, and an energy efficient arrangement 70. A predetermined amount of refrigerant may circulate through the various components (described below) of the air conditioning and heat pump tower through the connecting pipes 20. The air conditioning and heat pump tower is positioned at an opening of a wall 100 which creates an indoor space 101 and an outdoor space 102 on two sides of the wall 100 respectively.

The main casing 10 may comprise a partitioning wall 11 and may have an indoor portion 12 exposed to the indoor space 101, an outdoor portion 13 exposed to the outdoor space 102 (i.e. ambient atmosphere), a receiving cavity 14 formed in the main casing 10. The partitioning wall 11 may be arranged to divide the receiving cavity 14 into a front compartment 141 and a rear compartment 142.

The main casing 10 may further have an indoor air inlet 15, an indoor air outlet 16, at least one outdoor air inlet 17, an outdoor air outlet 18 and at least one outdoor air intake opening 19. The indoor air inlet 15 may be formed on the indoor portion 12 of the main casing 10, and communicating the front compartment 141 with the indoor space 101. The indoor air outlet 16 may also be formed on the indoor portion 12 of the main casing 10, and communicating the front compartment 141 with the indoor space 101.

Figure 4:
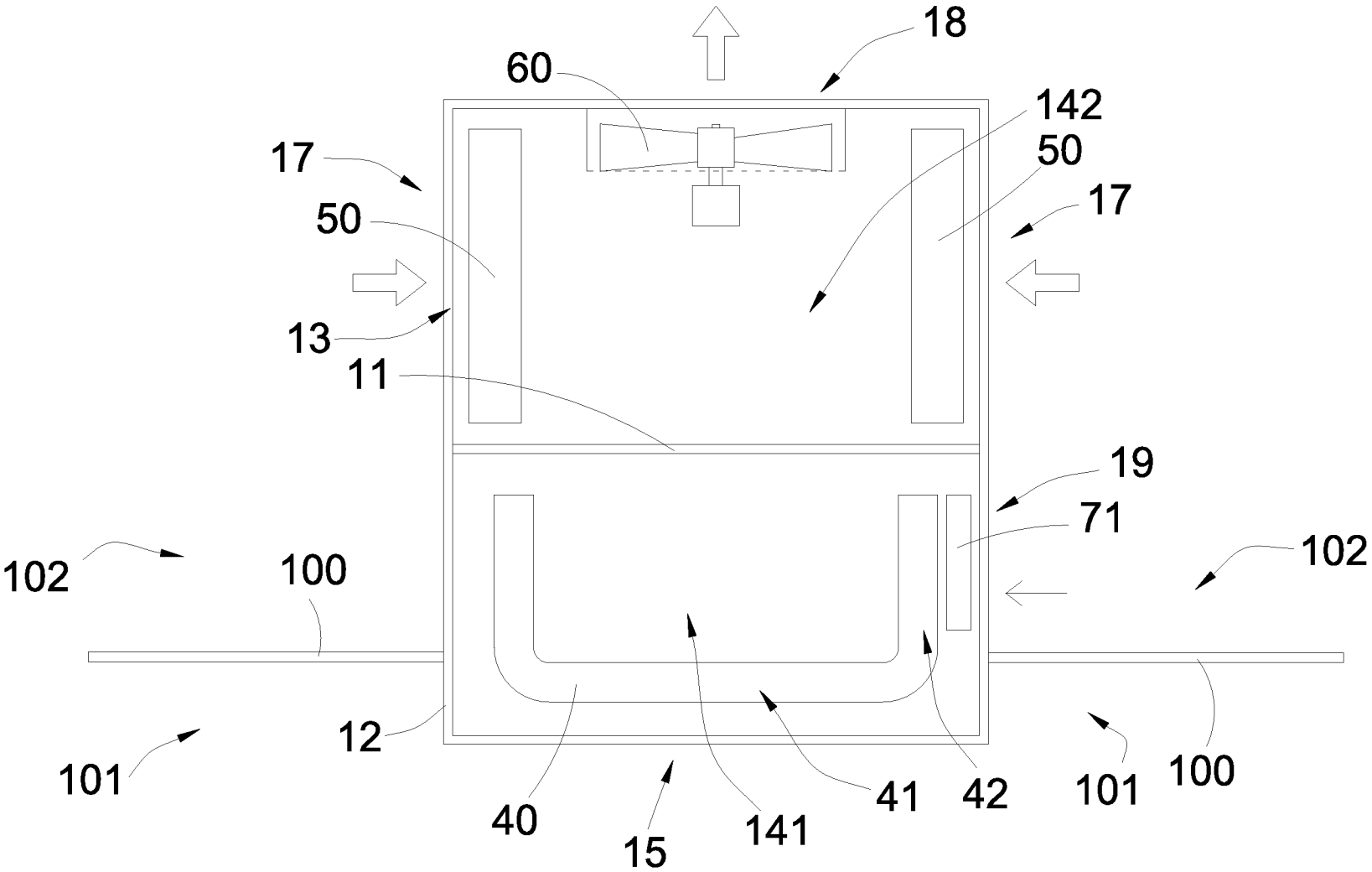
FIG. 4 is a sectional view of the air conditioning and heat pump tower along plane A-A of FIG. 2.

The outdoor air inlet 17 may be formed on two sides of the outdoor portion 13 of the main casing 10, and communicating the rear compartment 142 with the outdoor space 102. The outdoor air outlet 18 may be formed a rear side of the outdoor portion 13 of the main casing 10, and communicating the rear compartment 142 with the outdoor space 102. The outdoor air intake opening 19 may be formed on the outdoor portion 13 of the main casing 10, and communicating the front compartment 141 with the outdoor space 102. As shown in FIG. 4 of the drawings, the main casing 10 may have two outdoor air inlets 17 formed on two sides of the outdoor portion 13 so that ambient air may be drawn to the rear compartment 142 of the receiving cavity 14 through the outdoor air inlets 17.

The compressor 30 may be supported in the main casing 10, and may have a compressor outlet 31 and a compressor inlet 32.

The front heat exchanger 40 may be supported in the front compartment 141 of the receiving cavity 14 of the main casing 10, and may be connected to the compressor 30 through at least one of the connecting pipes 20. The front heat exchanger 40 may have an indoor heat exchanging portion 41 extending in the indoor portion 12 of the main casing 10, and an outdoor heat exchanging portion 42 extending in the outdoor portion 13 of the main casing 10.

The rear heat exchanger 50 may be supported in the rear compartment 142 of the receiving cavity 14 of the main casing 10, and may be connected to the compressor 30 and the front heat exchanger 40 through at least one of the connecting pipes 20.

The fan unit 50 may be supported in the main casing 10 for drawing air to flow through the main casing 10 from the indoor space 101 to the outdoor space 102, or vice versa.

The energy efficient arrangement 70 may comprise a first pre-heating heat exchanger 71 supported in the front compartment 141 of the receiving cavity 14 at an outdoor portion 13 of the main casing 10. The first pre-heating heat exchanger 71 may be positioned between the outdoor air intake opening 19 and the outdoor heat exchanging portion 42 of the front heat exchanger 40 and may be connected between the front heat exchanger 40 and the rear heat exchanger 50.

The air conditioning and heat pump tower may be selectively operated in at least one of an air conditioning mode and a heat pump mode. In the air conditioning mode, a predetermined amount of vaporous refrigerant may be arranged to leave the compressor 30 and guided to enter the rear heat exchanger 50 for releasing heat to ambient atmosphere, the refrigerant leaving the rear heat exchanger 50 may be guided to flow into the front heat exchanger 40 for absorbing heat from the indoor space 101. The refrigerant leaving the front heat exchanger 40 may be guided to flow back to the compressor 30 to complete an air conditioning cycle. In the air conditioning mode, the air conditioning and heat pump tower may be configured to absorb or extract heat from the indoor space 101 so as to reduce the temperature thereof.

When the air conditioning and heat pump tower is in the heat pump mode, a predetermined amount of vaporous refrigerant may be arranged to leave the compressor 30 and guided to flow into the front heat exchanger 40 for releasing heat to the indoor space 101. The refrigerant leaving the front heat exchanger 40 may be guided to flow into the first pre-heating heat exchanger 71 of the energy efficient arrangement 70 for releasing heat to ambient air drawn from the outdoor air intake opening 19. The refrigerant leaving the first pre-heating heat exchanger 71 may be guided to flow into the rear heat exchanger 50 for absorbing heat from ambient air drawn from the outdoor air inlets 17. The refrigerant leaving the rear heat exchanger 50 may be guided to flow to back the compressor 30 to complete a heat pump cycle. In the heat pump mode, the air conditioning and heat pump tower may be configured to produce and deliver heat to the indoor space 101 so as to increase the temperature thereof.

According to the first preferred embodiment, the air conditioning and heat pump tower may be installed at an opening of the wall 100 so that the main casing 10 thermally communicates the indoor space 101 with the outdoor space 102. The air conditioning and heat pump tower may directly deliver heat to or extract heat from the indoor space 101. No intermediate heat exchange agent such as water is needed.

The compressor 30 may be configured to pressurize the refrigerant flowing therethrough. It forms a starting point of refrigerant circulation for a typical air conditioning cycle or a heat pump cycle. The compressor 30 may be mounted in the front compartment 141 of the receiving cavity 14.

The front heat exchanger 40 may have a first communicating port 43 and a second communicating port 44, and may be configured to perform heat exchange between the refrigerant and the air passing through the front heat exchanger 40. The front heat exchanger 40 may be configured to act as an evaporator (i.e. converting the refrigerant into gaseous or vaporous state) when the air conditioning and heat pump tower is operated in the air conditioning mode. Conversely, the front heat exchanger 40 may be configured to act as a condenser (i.e. converting the refrigerant into liquid state) when the air conditioning and heat pump tower is operated in the heat pump mode.

Figure 2:
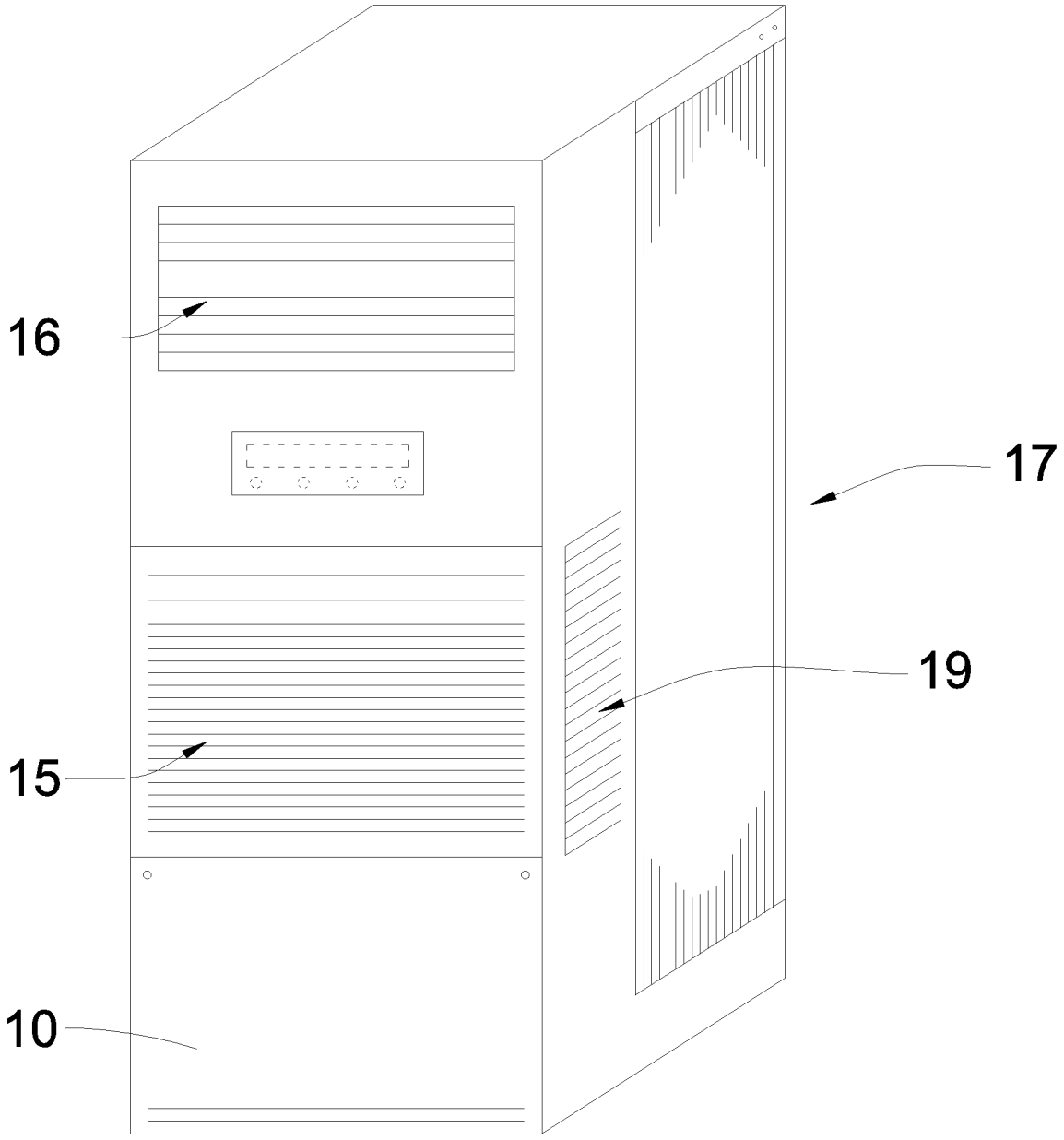
FIG. 2 is a perspective view of an air conditioning and heat pump tower according to a first preferred embodiment of the present invention.
Figure 3:
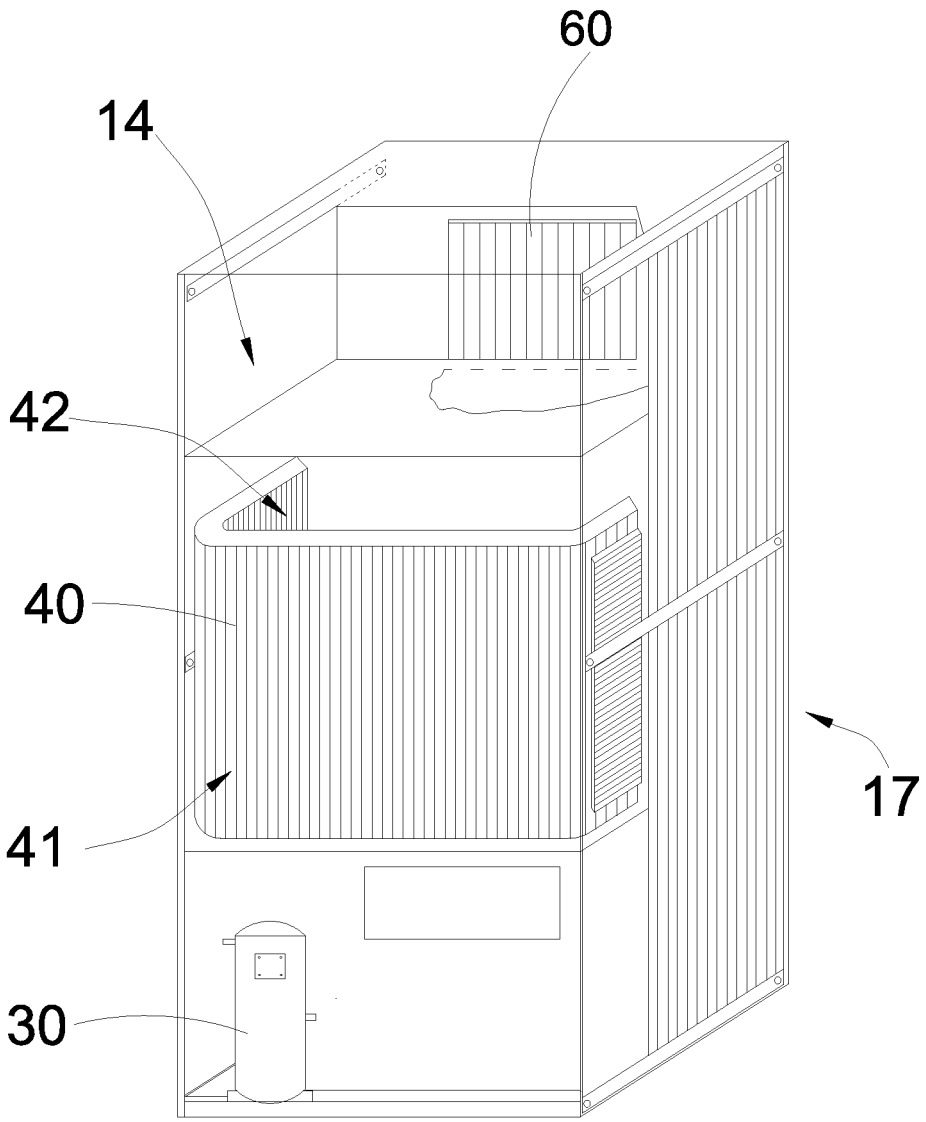
FIG. 3 is a schematic perspective view of an air conditioning and heat pump tower according to a first preferred embodiment of the present invention, illustrating the internal structure inside a main casing.

As shown in FIG. 3 to FIG. 4 of the drawings, the indoor heat exchanging portion 41 of the front heat exchanger 40 may extend along a transverse direction of the main casing 10 in the indoor portion 12 thereof, and may be positioned adjacent to the indoor air inlet 15. Air from the indoor space 101 may be drawn into the receiving cavity 14 and may be guided to pass through the indoor heat exchanging portion 41 so as to carry out heat exchange with the refrigerant passing through the indoor heat exchanging portion 41 of the front heat exchanger 40. The air having passed through the indoor exchanging portion 41 may be guided to be re-delivered back to the indoor space 101 through the indoor air outlet 16. The indoor air inlet 15 may be positioned below the indoor air outlet 16, as shown in FIG. 2 of the drawings.

Figure 5:
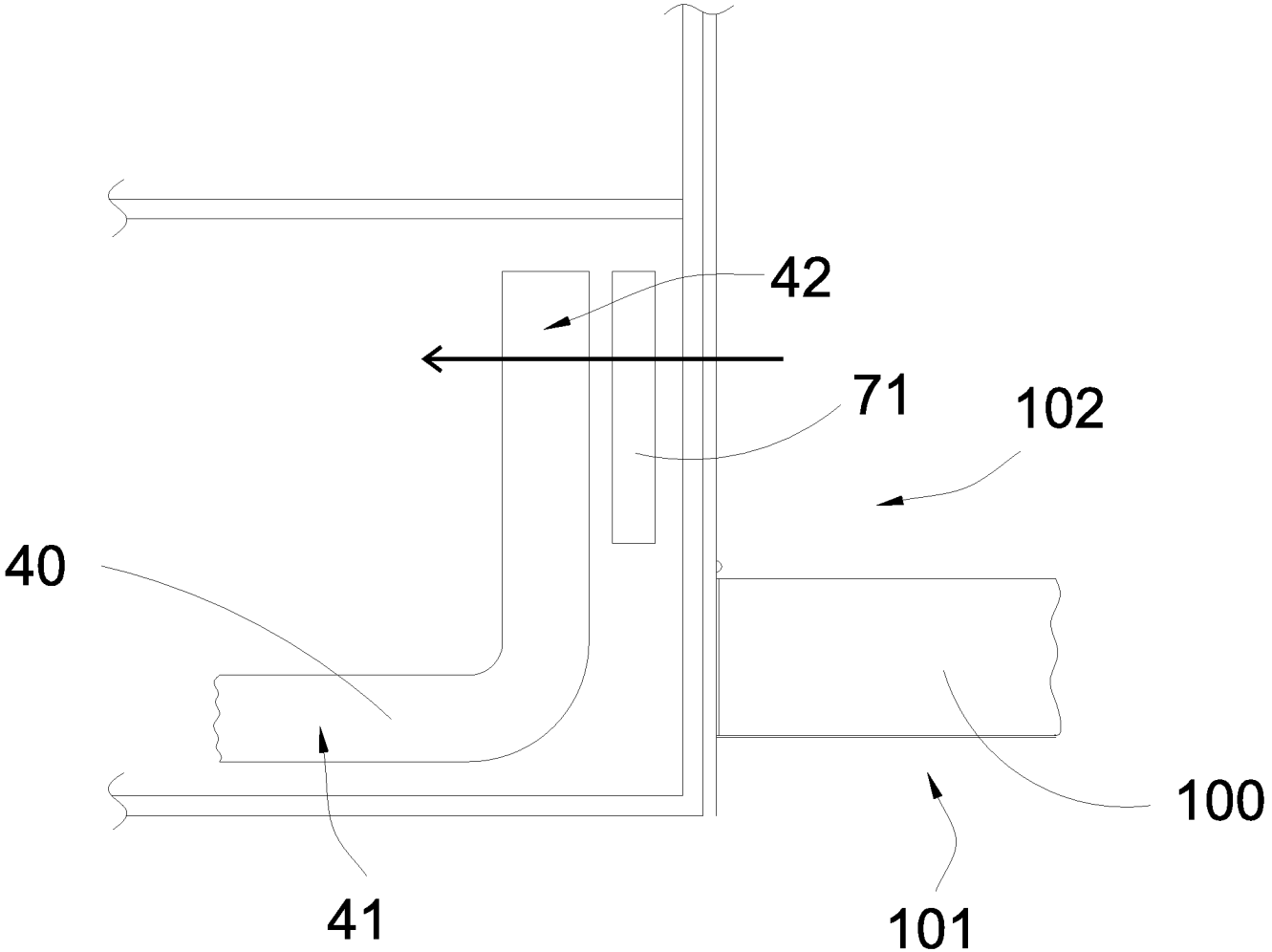
FIG. 5 is a schematic diagram of an energy efficient arrangement of the air conditioning and heat pump tower according to the first preferred embodiment of the present invention.

The outdoor heat exchanging portion 42 of the front heat exchanger 40 may be rearwardly extended from at least one end portion of the indoor heat exchanging portion 41 to a position adjacent to the outdoor air intake opening 19. The outdoor heat exchanging portion 42 may be arranged to be disposed in the outdoor portion 13 of the main casing 10 so that it may be in thermal communication with the ambient air drawn from the outdoor air intake opening 19. This configuration of the front heat exchanger 40 is illustrated in FIG. 4 and FIG. 5 of the drawings.

In this preferred embodiment of the present invention, the air conditioning and heat pump tower may comprise two (but at least one) rear heat exchangers 50 provided on two sides of the rear compartment 142, wherein each of the rear heat exchangers 50 may be in thermal communication with the outdoor air inlets 17 respectively. When two rear heat exchangers 50 are utilized, they may be connected in parallel.

Each of the rear heat exchangers 50 may have a first passage port 51 and a second passage port 52, and may be configured to perform heat exchange between the refrigerant and ambient air drawn from the corresponding outdoor air inlets 17. The rear heat exchangers 50 may be configured to act as a condenser (i.e. converting the refrigerant into liquid state) when the air conditioning and heat pump tower is operated in the air conditioning mode. Conversely, the rear heat exchangers 50 may be configured to act as an evaporator (i.e. converting the refrigerant into gaseous or vaporous state) when the air conditioning and heat pump tower is operated in the heat pump mode. The first passage port 51 and the second passage port 52 may form as an inlet or outlet for the refrigerant passing through the rear heat exchanger 50.

The compressor 30, the front heat exchanger 40 and the rear heat exchangers 50 may be arranged and connected through the connecting pipes 20 in certain configurations. An exemplary configuration is shown in FIG. 6 of the drawings.

The air conditioning and heat pump tower may further comprise a switching device 80 connecting between the compressor 80, the first main heat exchanger 40 and the second main heat exchangers 50 for altering a flowing path of the refrigerant. Specifically, the switching device 80 may have first through fourth connecting port 81, 82, 83, 84, and may be switched between an air conditioning switching mode and a heat pump switching mode, wherein in the air conditioning switching mode, the first connecting port 81 may be connected to the second connecting port 82 so that refrigerant may flow from the first connecting port 81 to the second connecting port 82, while the third connecting port 83 may be connected to the fourth connecting port 84 so that refrigerant may flow from the third first connecting port 83 to the fourth connecting port 84.

In the heat pump switching mode, the switching device 80 may be switched so that the first connecting port 81 may be connected to the third connecting port 83 so that refrigerant may flow from the first connecting port 81 to the third connecting port 83, while the second connecting port 82 may be connected to the fourth connecting port 84, so that refrigerant may flow from the second connecting port 82 to the fourth connecting port 84.

Figure 6:
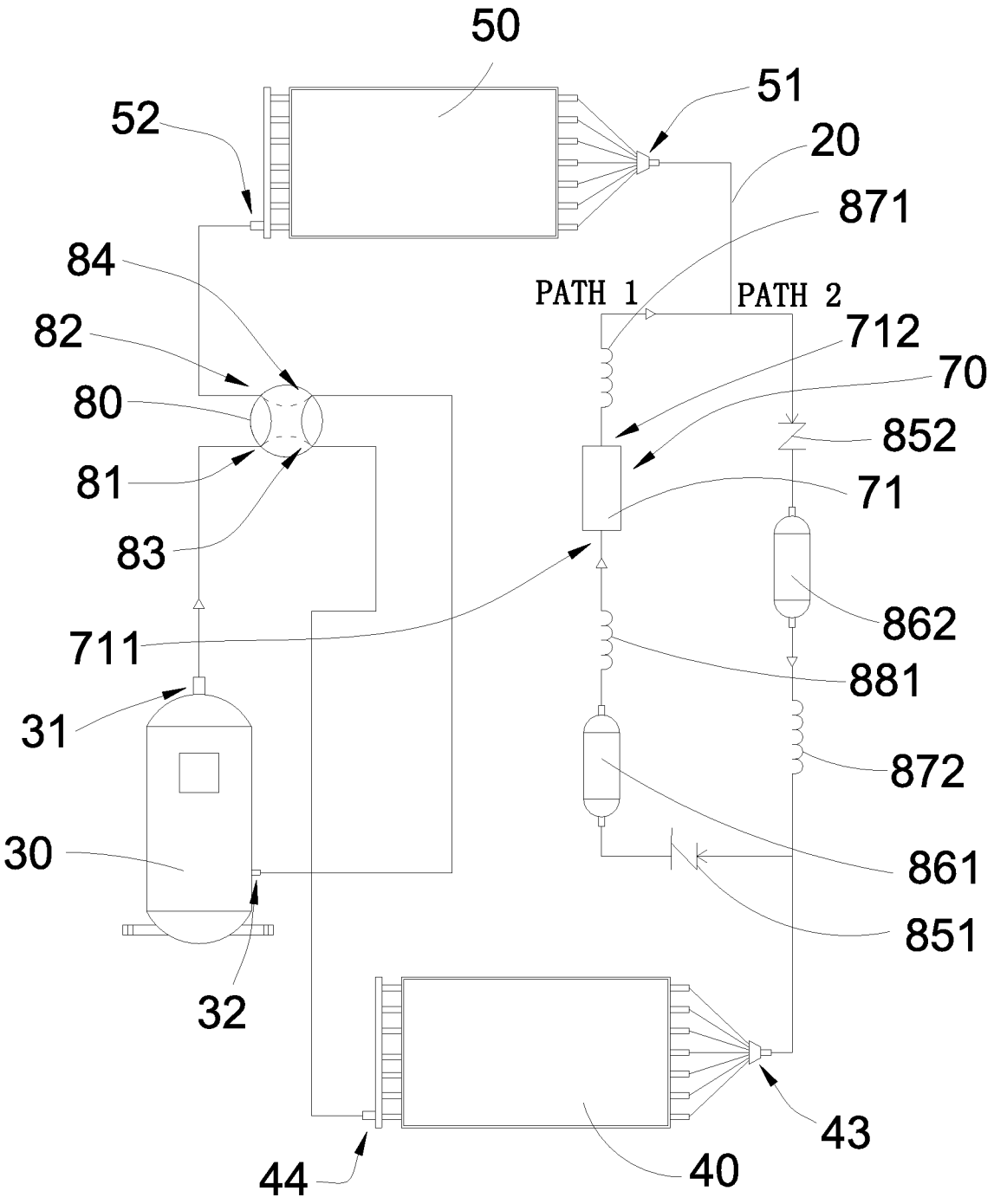
FIG. 6 is a schematic diagram of the air conditioning and heat pump tower according to the first preferred embodiment of the present invention, illustrating an overall flowing path of refrigerant.

As shown in FIG. 6 of the drawings, the first connecting port 81 may be connected to the compressor outlet 31 of the compressor 30. The second connecting port 82 may be connected to the second passage ports 52 of the rear heat exchangers 50 in parallel. The third connecting port 83 may be connected to the second communicating port 44 of the front heat exchanger 40. The fourth connecting port 84 may be connected to the compressor inlet 32 of the compressor 30.

The first passage port 51 of each of the second main heat exchangers 50 may be connected to the first communicating port 43 of the front heat exchanger 40 through various components connected in parallel. An exemplary configuration is shown in FIG. 6 of the drawings. For the sake of clarity and ease of reading, the two parallel paths are designated path 1 and path 2 in FIG. 6. "Path" refers to the flowing path of the refrigerant.

The air conditioning and heat pump tower may further comprise a first unidirectional valve 851 and a second unidirectional valve 852 which are connected in path 1 and path 2 respectively. The first and second unidirectional valve 851, 852 may be configured to restrict the flow of refrigerant in one predetermined direction, and not vice versa. In the first preferred embodiment, the first unidirectional valve 851 may be configured to allow the refrigerant to flow from the front heat exchanger 40 toward the rear heat exchangers 50 through path 1. The second unidirectional valve 852 may be configured to allow the refrigerant to flow from the rear heat exchangers 50 toward the front heat exchanger 40 through path 2.

The air conditioning and heat pump tower may further comprise a first filtering device 861 and a second filtering device 862 connected in series to the first unidirectional valve 851 in path 1 and the second unidirectional valve 862 in path 2 respectively. The first filtering device 861 and the second filtering device 862 may be configured to filter unwanted substances from the refrigerant which pass through them.

The air conditioning and heat pump tower may further comprise a first expansion valve 871 and a second expansion valve 872 connected in series to the first pre-heating heat exchanger 71 in path 1 and the second filtering device 862 in path 2 respectively. The first expansion valve 871 and the second expansion valve 872 may be configured to control and regulate the flow of the refrigerant passing through them. Thus, the first pre-heating heat exchanger 71 may be connected in path 1 between the first expansion valve 871 and the first filtering device 861.

The air conditioning and heat pump tower may further comprise a first flow regulating valve 881 connected between the first pre-heating heat exchanger 71 and the first filtering device 861 in path 1. The first flow regulating valve 881 may be configured to lower the pressure of the refrigerant which passes through it.

The first pre-heating heat exchanger 71 of the energy efficient arrangement 70 may be mounted in the main casing 11 in the outdoor portion 13 thereof. The first pre-heating heat exchanger 71 may be positioned in a space between the outdoor air intake opening 19 and the outdoor heat exchanging portion 42 of the front heat exchanger 40. The first pre-heating heat exchanger 71 may be connected in series between the first expansion valve 871 and the first flow regulating 881 in path 1. Ambient air which enters the main casing 10 may be arranged to first pass through the first pre-heating heat exchanger 71 and then the outdoor heat exchanging portion 42 of the front heat exchanger 40. The first pre-heating heat exchanger 71 may have a first refrigerant inlet 711 and a first refrigerant outlet 712.

The operation of the present invention is as follows: the air conditioning and heat pump tower described above involves a refrigerant flowing cycle which may flow through the above-mentioned components for carrying out heat exchange processes.

When the air conditioning and heat pump tower is in the air conditioning mode, it is configured to generate cool air to the indoor space 101. A refrigerant cycle starts from the compressor 30. Superheated or vaporous refrigerant may be arranged to leave the compressor 30 through the compressor outlet 31. The switching device 80 may be switched to air conditioning switching mode. The refrigerant leaving the compressor 30 may pass through the first connecting port 81, the second connecting port 82, and be bifurcated and enter the rear heat exchangers 50 through the corresponding second passage ports 52. The refrigerant may then perform heat exchange with a coolant such as ambient air drawn from the outdoor air inlets 17 so as to release heat to ambient air. The ambient air may be discharged out of the outdoor compartment 142 through the outdoor air outlet 18. The refrigerant may convert into liquid state after releasing heat. The refrigerant may then be guided to exit the rear heat exchangers 50 through the first passage ports 51. The refrigerant leaving the rear heat exchanger 50 may be merged and then be guided to flow through the second unidirectional valve 852, the second filtering device 862, and the second expansion valve 872 connected in path 2. The refrigerant may be prevented from entering path 1 by the first unidirectional valve 851 at this time. The refrigerant may then be guided to enter the front heat exchanger 40 through the first communicating port 43. The refrigerant entering the front heat exchanger 40 may then be arranged to perform heat exchange with the air drawn from the indoor space through the indoor air inlet 15 and the air drawn from the outdoor air intake opening 19 so as to absorb heat from the air and be converted back into vaporous or superheated state. The refrigerant may then be guided to leave the front heat exchanger 40 through the second communicating port 44. The refrigerant may then be guided to flow through the third connecting port 83 and the fourth connecting port 84 of the switching device 80 and eventually flow back to the compressor 30 through the compressor inlet 32. This completes one refrigerant cycle for the air conditioning mode.

Note that when the air conditioning and heat pump tower is in the air conditioning mode, the energy efficient arrangement 70 may be deactivated.

When the air conditioning and heat pump tower is in the heat pump mode, it is configured to generate heat to indoor space 101. The corresponding refrigerant cycle also starts from the compressor 30. Superheated or vaporous refrigerant may be arranged to leave the compressor 30 through the compressor outlet 31. The switching device 80 may be switched to heat pump mode. The refrigerant leaving the compressor 30 may pass through the first connecting port 81, the third connecting port 83, and enter the front heat exchanger 40 through the second communicating port 44. The refrigerant may then perform heat exchange with the air drawn from the indoor space 101 and release heat to the indoor air. The refrigerant may be converted into liquid state after releasing heat. The refrigerant may then be guided to exit the front heat exchanger 40 through the first communicating port 43. The refrigerant leaving the front heat exchanger 40 may then be guided to flow through the first unidirectional valve 851, the first filtering device 861, and the first flow regulating valve 881 connected in path 1. Note that the refrigerant may be prevented from entering path 2 by the second unidirectional valve 852 at this time.

The refrigerant may then be guided to enter the first pre-heating heat exchanger 71 of the energy efficient arrangement 70 through the first refrigerant inlet 711 for releasing heat to the air drawn from the outdoor air intake opening 19. The refrigerant may then be arranged to flow out of the first pre-heating heat exchanger 71 through the first refrigerant outlet 712 and is guided to flow through the first expansion valve 871 in path 1. The second unidirectional valve 852 may prevent the refrigerant from entering path 2. As a result, the refrigerant may then be bifurcated and guided to enter the rear heat exchangers 50 through the corresponding first passage ports 51. The refrigerant may be arranged to perform heat exchange and absorb heat from ambient air in the rear heat exchanger 50. The ambient air may be drawn from the outdoor air inlet 17 of the main casing 10 and discharged therefrom through the outdoor air outlet 18. The refrigerant may then evaporate to become vaporous or superheated state. The refrigerant may then be guided to leave the rear heat exchangers 50 through the corresponding second passage ports 52. The refrigerant may then be guided to flow through the second connecting port 82 and the fourth connecting port 84 of the switching device 80 and eventually flow back to the compressor 30 through the compressor inlet 32. This completes one refrigerant cycle for the heat pump mode.

In the heat pump mode, the energy efficient arrangement 70 may be activated for pre-heating the ambient air drawn from ambient atmosphere. The refrigerant passing through the pre-heating heat exchanger 71 may transfer a predetermined amount of heat to the ambient air. The air may then be guided to pass through the outdoor heat exchanging portion 42 of the front heat exchanger 40 for being further heated. Fresh ambient air, which have been pre-heated by the pre-heating heat exchanger 70 and the outdoor heat exchanging portion 42 of the front heat exchanger 40, may then be delivered to the indoor space 101 through the indoor air outlet 16.

On the other hand, by pre-heating the ambient air by the energy efficient arrangement 70, the overall Coefficient of Performance (C.O.P) of the entire air conditioning and heat pump tower may be substantially increased. By utilizing the heat of the refrigerant in path 1, the ambient air may be pre-heated so that less energy may be used to raise the temperature of the ambient air to a predetermined targeted temperature before it is delivered to the indoor space 101. Moreover, by transferring some of the heat of the refrigerant flowing through path 1, the temperature of the refrigerant entering the second main heat exchangers 50 may be lowered as compared with conventional heat pump systems. The lower the temperature of the refrigerant entering the rear heat exchangers 50, the more heat the refrigerant may absorb from ambient air for a given compression performance. Thus, for a given work done by the compressor 30, more heat may be generated by the air conditioning and heat pump tower.

Figure 7:
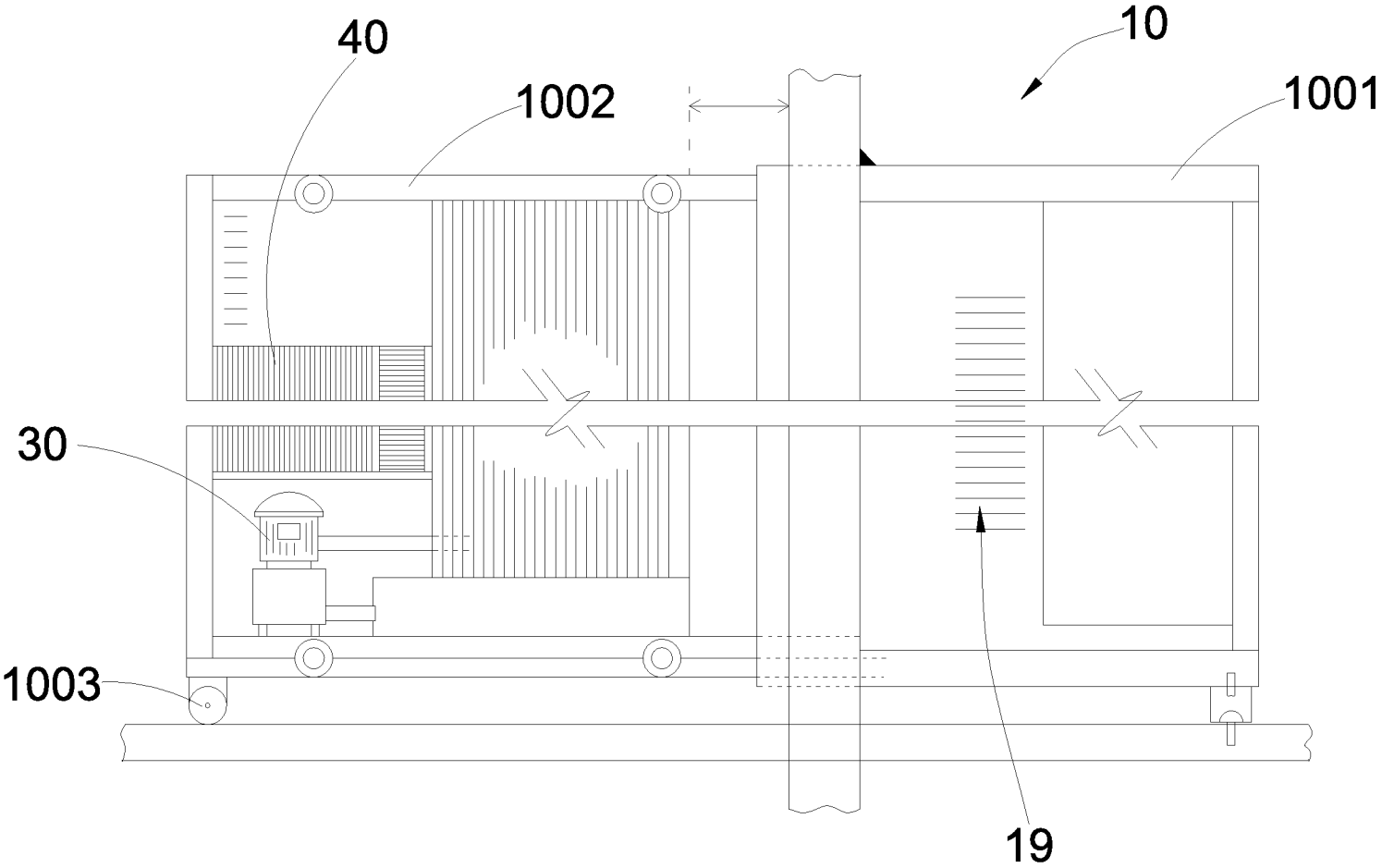
FIG. 7 is a schematic diagram of the air conditioning and heat pump tower according to the first preferred embodiment of the present invention, illustrating that a main casing may comprise an external casing and a supporting casing.

Referring to FIG. 7 of the drawings, the air conditioning and heat pump tower of the present invention may be installed on a wall 100. The main casing 10 may further comprise an external casing 1001 and a supporting casing 1002 supporting all the above-mentioned components of the air conditioning and heat pump tower, and a plurality of wheels 1003 connected to a bottom portion of the supporting casing 1002. The supporting casing 1002 may be slidably connected to the external casing 1001. When it is slid out of the external casing 1001, all the components of the air conditioning and heat pump tower may be conveniently and easily maintained or repaired.

As may be appreciated, a feature of the present invention is that the air conditioning tower may be easily installed on premises. The air conditioning and heat pump tower does not need to have any mounting devices for mounting the main casing 10 to the wall 100. What is needed is just for a user of the present invention to form an opening on the wall 1001 and then put the air conditioning and heat pump tower in a proper position of the wall 100.

Figure 8:
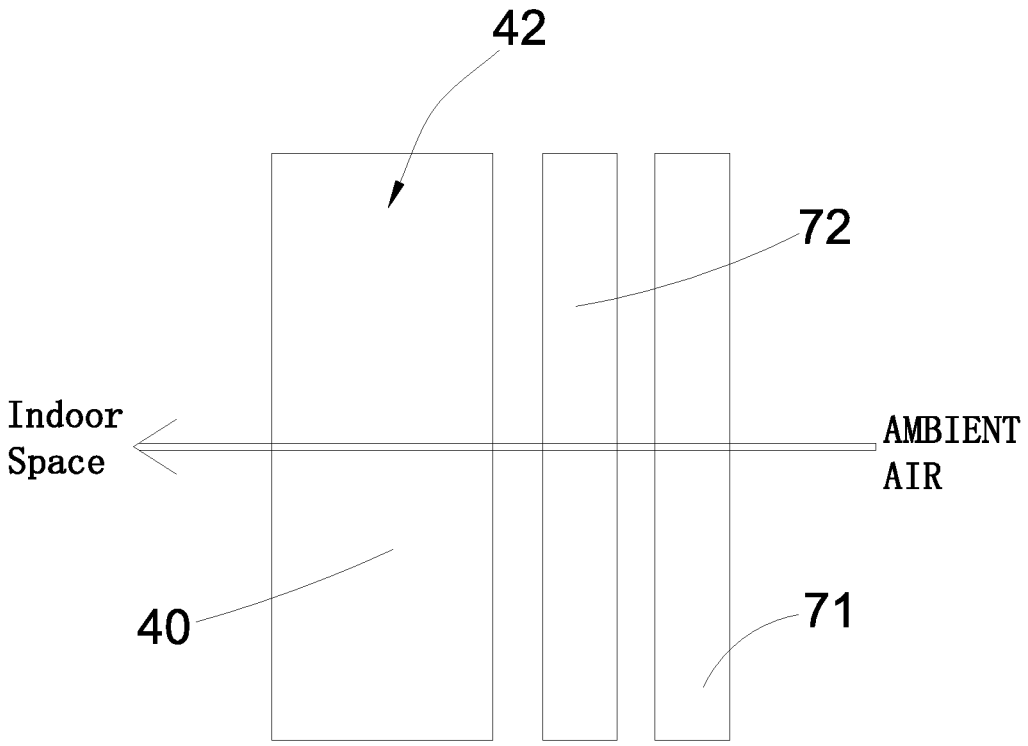
FIG. 8 is a schematic diagram of the energy efficient arrangement of the air conditioning and heat pump tower according to a second preferred embodiment of the present invention.
Figure 9:
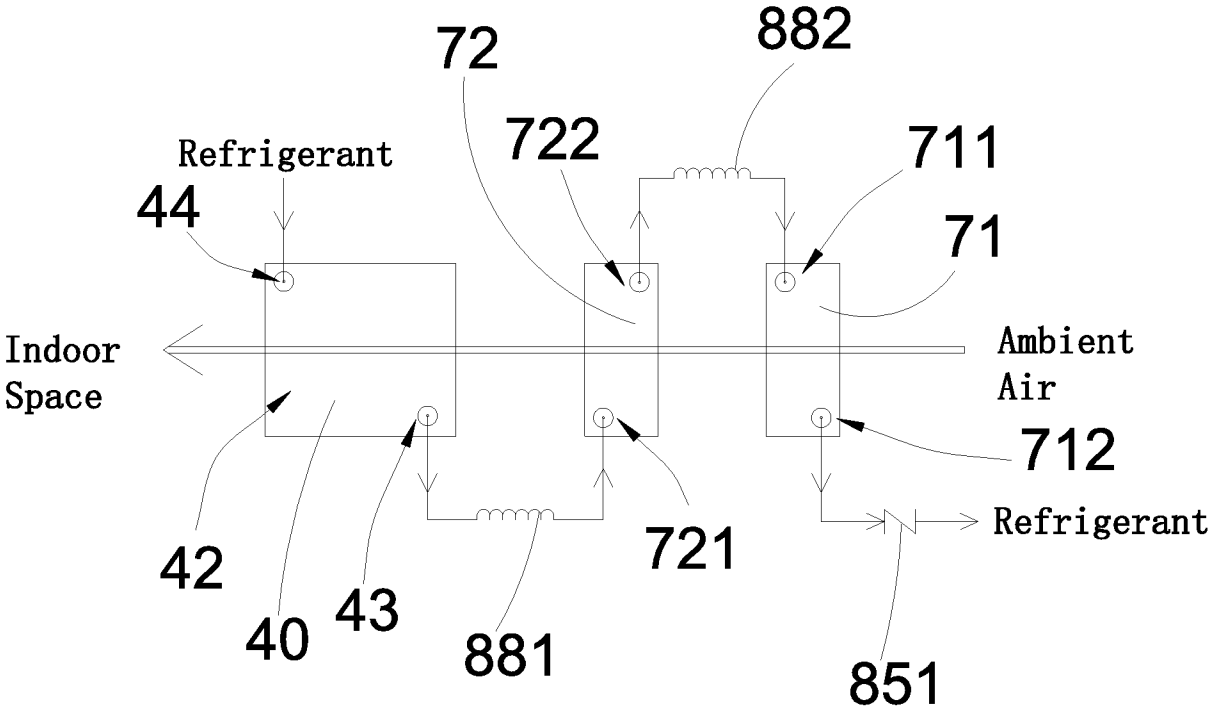
FIG. 9 is a simplified schematic diagram of the energy efficient arrangement of the air conditioning and heat pump tower according to the second preferred embodiment of the present invention, illustrating a flowing path of the ambient air.
Figure 10:
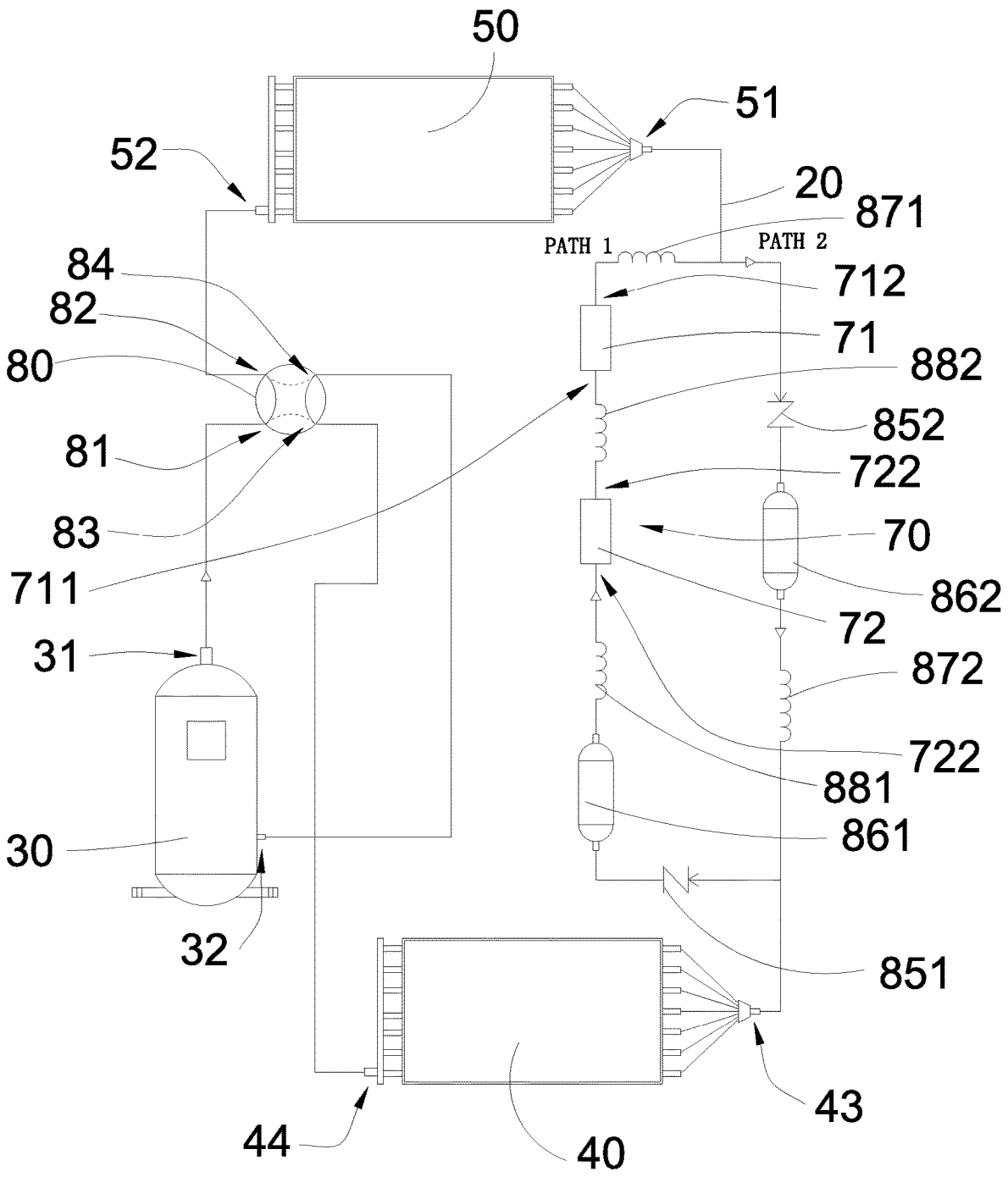
FIG. 10 is a schematic diagram of the air conditioning and heat pump tower according to the second preferred embodiment of the present invention, illustrating an overall flowing path of refrigerant.

Referring to FIG. 8 to FIG. 10 of the drawings, the air conditioning and heat pump tower according to a second preferred embodiment of the present invention is illustrated. The second preferred embodiment is structurally similar to that of the first preferred embodiment described above, except that the energy efficient arrangement 70 may further comprise a second pre-heating heat exchanger 72 connected between the first pre-heating heat exchanger 71 and the first flow regulating valve 881. According to the second preferred embodiment, the second pre-heating heat exchanger 72 may be connected in series to the first pre-heating heat exchanger 71 in path 1. A second flow regulating valve 882 may be connected between the first pre-heating heat exchanger 71 and the second pre-heating heat exchanger 72. The refrigerant leaving the front heat exchanger 40 may pass through the second pre-heating heat exchanger 72 before reaching the first pre-heating heat exchanger 71.

Thus, the second pre-heating heat exchanger 72 may have a second refrigerant inlet 721 connected in series to the first flow regulating valve 881 in path 1, and a second refrigerant outlet 722 connected in series to the second flow regulating valve 882, which may be connected in series to the first refrigerant inlet 711 of the first pre-heating heat exchanger 71. The first refrigerant outlet 712 of the first pre-heating heat exchanger 71 may be connected in series to the first expansion valve 871.

As shown in FIG. 7 to FIG. 8 of the drawings, the first pre-heating heat exchanger 71 and the second pre-heating heat exchanger 72 may be positioned between the outdoor air intake opening 19 and outdoor heat exchanging portion 42 of the front heat exchanger 40 in such a manner that ambient air drawn from the outdoor air intake opening 19 may be arranged to sequentially pass through the first pre-heating heat exchanger 71, the second pre-heating heat exchanger 72 and the outdoor heat exchanging portion 42.

The operation of the present invention according to the second preferred embodiment is described as follows: the air conditioning and heat pump tower described above involves a refrigerant flowing cycle. When the air conditioning and heat pump tower is in the air conditioning mode, it is configured to generate cool air to the indoor space 101. A refrigerant cycle starts from the compressor 30. Superheated or vaporous refrigerant may be arranged to leave the compressor 30 through the compressor outlet 31. The switching device 80 may be switched to the air conditioning switching mode. The refrigerant leaving the compressor 30 may pass through the first connecting port 81, the second connecting port 82, and may be bifurcated to enter the rear heat exchangers 50 through the second passage ports 52. The refrigerant may then perform heat exchange with ambient air drawn from the outdoor air outlets 17 and release heat to the ambient air. The ambient may be discharged out of the outdoor compartment 142 through the outdoor air outlet 18. The refrigerant may be converted into liquid state after releasing heat. The refrigerant may then be guided to exit the rear heat exchangers 50 through the first passage ports 51. The refrigerant leaving the rear heat exchanger 50 may be merged and guided to flow through the second unidirectional valve 852, the second filtering device 862, and the second expansion valve 872 connected in path 2. The refrigerant may be prevented from entering path 1 by the first unidirectional valve 851 at this time. The refrigerant may then be guided to enter the front heat exchanger 40 through the first communicating port 43. The refrigerant entering the front heat exchanger 40 may then be arranged to perform heat exchange with the air drawn from the indoor air inlet 15 so as to absorb heat from the indoor air. The refrigerant may then be converted back into vaporous or superheated state. The refrigerant may then be guided to leave the front heat exchanger 40 through the second communicating port 44. The refrigerant may then be guided to flow through the third connecting port 83 and the fourth connecting port 84 of the switching device 80 and eventually flow back to the compressor 30 through the compressor inlet 32. This completes one refrigerant cycle for air conditioning mode. Note that this refrigerant cycle is the same as in the first preferred embodiment.

When the air conditioning and heat pump tower is in the air conditioning mode, the energy efficient arrangement 70 may be deactivated.

When the air conditioning and heat pump tower is in the heat pump mode, it may be configured to generate heat to the indoor space 101. The corresponding refrigerant cycle also starts from the compressor 30. Superheated or vaporous refrigerant may be arranged to leave the compressor 30 through the compressor outlet 31. The switching device 80 may be switched to heat pump switching mode. The refrigerant leaving the compressor 30 may pass through the first connecting port 81, the third connecting port 83, and enter the front heat exchanger 40 through the second communicating port 44. The refrigerant may then perform heat exchange with the air drawn from the indoor space 101 so as to release heat to the indoor air. The indoor air may then be delivered back to the indoor space 101 through the indoor air outlet 18. The refrigerant may be converted into liquid state after releasing heat. The refrigerant may then be guided to exit the front heat exchanger 40 through the first communicating port 43. The refrigerant leaving the front heat exchanger 40 may then be guided to flow through the first unidirectional valve 851, the first filtering device 861, and the first flow regulating valve 881 in path 1. The refrigerant may be prevented from entering path 2 by the second unidirectional valve 852 at this time.

The refrigerant may then be guided to enter the second pre-heating heat exchanger 72 of the energy efficient arrangement 70 through the second refrigerant inlet 721 for releasing heat to the ambient air flowing through the second pre-heating heat exchanger 72 (after passing through the first pre-heating heat exchanger 71). The refrigerant may then exit the second pre-heating heat exchanger 72 through the second refrigerant outlet 722 and pass through the second flow regulating valve 882 and enter the first pre-heating heat exchanger 71 through the first refrigerant inlet 711. The refrigerant may release heat to the ambient air drawn from the outdoor air intake opening 19. The refrigerant may then leave the first pre-heating heat exchanger 71 through the first refrigerant outlet 712 and may be guided to flow through the first expansion valve 871 in path 1. The second unidirectional valve 852 may prevent the refrigerant from entering path 2. As a result, the refrigerant may be bifurcated and guided to enter the rear heat exchangers 50 through the first passage ports 51. The refrigerant may be arranged to perform heat exchange and absorb heat from ambient air in the rear heat exchangers 50. The refrigerant may then evaporate to become vaporous or superheated state. The refrigerant may then be guided to leave the second main heat exchangers 50 through the second passage ports 52. The refrigerant may then be guided to flow through the second connecting port 82 and the fourth connecting port 84 of the switching device 80 and eventually flow back to the compressor 30 through the compressor inlet 32. This completes one refrigerant cycle for the heat pump mode.

The principles by which energy may be saved has been described above in the first preferred embodiment. Note that by passing through one more pre-heating heat exchanger, the temperature of the refrigerant entering the rear heat exchangers 50 will be lower than that of the first preferred embodiment. The number of pre-heating heat exchangers may also be increased or altered. The first preferred embodiment and the second preferred embodiment described above are only exemplary configurations of carrying out the present invention.

The present invention, while illustrated and described in terms of a preferred embodiment and several alternatives, is not limited to the particular description contained in this specification. Additional alternative or equivalent components could also be used to practice the present invention.

What is claimed is:

1. An air conditioning and heat pump tower being positioned at an opening of a wall which creates an indoor space and an outdoor space on two sides of said wall, said air conditioning and heat pump tower comprising:

a main casing comprising a partitioning wall, and having:

an indoor portion exposed to said indoor space;

an outdoor portion exposed to said outdoor space;

a receiving cavity formed in said main casing, said partitioning wall dividing said receiving cavity into a front compartment and a rear compartment;

an indoor air inlet being formed on said indoor portion of said main casing, and communicating said front compartment with said indoor space;

an indoor air outlet being formed on said indoor portion of said main casing, and communicating said front compartment with said indoor space;

an outdoor air inlet being formed on said outdoor portion of said main casing, and communicating said rear compartment with said outdoor space;

an outdoor air outlet being formed on said outdoor portion of said main casing, and communicating said rear compartment with said outdoor space; and at least one outdoor air intake opening being formed on said outdoor portion of said main casing, and communicating said front compartment with said outdoor space;

a plurality of connecting pipes received in said receiving cavity of said main casing;

a compressor supported in said main casing, said compressor having a compressor outlet and a compressor inlet;

a front heat exchanger supported in said front compartment of said main casing and connected to said compressor through at least one of said connecting pipes, said front heat exchanger has an indoor heat exchanging portion extending in said indoor portion of said main casing, and an outdoor heat exchanging portion extending in said outdoor portion of said main casing; and two rear heat exchangers supported in said rear compartment of said main casing and connected to said compressor and said front heat exchanger through at least one of said connecting pipes, said rear heat exchangers being connected in parallel, said main casing further having an outdoor air inlet, said outdoor air inlets being formed on two sides of said outdoor portion of said main casing, and communicating said rear compartment with said outdoor space, said two rear heat exchangers being positioned to align with said two outdoor air inlets respectively;

a fan supported in said main casing for drawing air to flow between said indoor space and said outdoor space; and an energy efficient arrangement, which comprises:

a first pre-heating heat exchanger supported in said front compartment of said receiving cavity at an outdoor portion of said main casing, said first pre-heating heat exchanger being positioned between said air intake opening and said outdoor heat exchanging portion of said front heat exchanger and connected between said front heat exchanger and said rear heat exchanger;

said air conditioning and heat pump tower being selectively operated between an air conditioning mode and a heat pump mode, wherein in said air conditioning mode, a predetermined amount of vaporous refrigerant is arranged to leave said compressor and guided to enter said rear heat exchanger for releasing heat to ambient atmosphere, said refrigerant leaving said rear heat exchanger being guided to flow into said front heat exchanger for absorbing heat from said indoor space, said refrigerant leaving said front heat exchanger being guided to flow back to said compressor to complete an air conditioning cycle, wherein in said heat pump mode, a predetermined amount of vaporous refrigerant is arranged to leave said compressor and guided to flow into said front heat exchanger as condenser for releasing heat to said indoor space, said refrigerant leaving said front heat exchanger being guided to flow into said first pre-heating heat exchanger for releasing heat to ambient air drawn from said outdoor air intake opening, said refrigerant leaving said first pre-heating heat exchanger being guided to flow into said rear heat exchanger as evaporator for absorbing heat from ambient air drawn from said outdoor air inlet, said refrigerant leaving said rear heat exchanger being guided to flow back to said compressor to complete a heat pump cycle.

2. The air conditioning and heat pump tower, as recited in claim 1, wherein said front heat exchanger has a first communicating port and a second communicating port, and is configured to perform heat exchange between said refrigerant and said air passing through said front heat exchanger, in such a manner that said front heat exchanger is configured to be an evaporator when said air conditioning and heat pump tower is operated in said air conditioning mode, and is configured to be a condenser when said air conditioning and heat pump tower is operated in said heat pump mode.

3. The air conditioning and heat pump tower, as recited in claim 2, wherein said indoor heat exchanging portion of said front heat exchanger extends along a transverse direction of said main casing in said indoor portion thereof, and is positioned adjacent to said indoor air inlet, so that air from said indoor space is capable of being drawn into said receiving cavity and guided to pass through said indoor heat exchanging portion for carrying out heat exchange with said refrigerant passing through said indoor heat exchanging portion of said front heat exchanger, said air passing through said indoor heat exchanging portion is re-delivered back to said indoor space through said indoor air outlet.

4. The air conditioning and heat pump tower, as recited in claim 3, wherein said outdoor heat exchanging portion of said front heat exchanger is rearwardly extended from one end portion of said indoor heat exchanging portion to a position adjacent to said outdoor air intake opening, said outdoor heat exchanging portion is arranged to be disposed in said outdoor portion of said main casing so as to thermal communicate with said ambient air drawn from said outdoor air intake opening.

5. The air conditioning and heat pump tower, as recited in claim 4, wherein each of said rear heat exchangers has a first passage port and a second passage port, and is configured to perform heat exchange between said refrigerant and ambient air drawn from said outdoor air inlets, said rear heat exchangers being configured to act as a condenser when said air conditioning and heat pump tower is operated in said air conditioning mode, and being configured to act as an evaporator when said air conditioning and heat pump tower is operated in said heat pump mode.

6. The air conditioning and heat pump tower, as recited in claim 5, further comprising a switching valve connecting between said compressor, said front heat exchanger and said rear heat exchangers, said switching valve having first connecting port, second connecting port, third connecting port, and fourth connecting port, and being configured to be switched between an air conditioning switching mode and a heat pump switching mode, wherein in said air conditioning switching mode, said first connecting port is connected to said second connecting port, while said third connecting port is connected to said fourth connecting port, wherein in said heat pump switching mode, said first connecting port is connected to said third connecting port, while said second connecting port is connected to said fourth connecting port.

7. The air conditioning and heat pump tower, as recited in claim 6, wherein said first connecting port of said switching valve is connected to said compressor outlet of said compressor, said second connecting port of said switching port being connected to said second passage port of said rear heat exchanger, said third connecting port of said switching port being connected to said second communicating port of said front heat exchanger, said fourth connecting port of said switching valve is connected to said compressor inlet of said compressor.

8. The air conditioning and heat pump tower, as recited in claim 7, further comprising a first unidirectional valve and a second unidirectional valve which are connected in parallel, said first unidirectional valve being configured to allow said refrigerant to flow in a direction from said front heat exchanger toward said rear heat exchanger, said second unidirectional valve being configured to allow said refrigerant to flow in a direction from said rear heat exchanger toward said front heat exchanger.

9. The air conditioning and heat pump tower, as recited in claim 8, further comprising a first filter and a second filter connected in series to said first unidirectional valve and said second unidirectional valve respectively.

10. The air conditioning and heat pump tower, as recited in claim 9, further comprising a first expansion valve and a second expansion valve connected in series to said first pre-heating heat exchanger and said second filter respectively.

11. The air conditioning and heat pump tower, as recited in claim 10, further comprising a first flow regulating valve connected between said first pre-heating heat exchanger and said first filter.

12. The air conditioning and heat pump tower, as recited in claim 11, wherein said first pre-heating heat exchanger is connected in series between said first expansion valve and said first flow regulating valve.

13. The air conditioning and heat pump tower, as recited in claim 12, wherein when in said air conditioning mode, said air conditioning and heat pump tower is configured such that said refrigerant sequentially passes through said compressor, said first connecting port of said switching valve, said second connecting port of said switching valve, said rear heat exchanger, said second unidirectional valve, said second filter, and said second expansion valve, said front heat exchanger, said third connecting port of said switching valve, said fourth connecting port of said switching valve, and back to said compressor.

14. The air conditioning and heat pump tower, as recited in claim 13, wherein when in said heat pump mode, said air conditioning and heat pump tower is configured such that said refrigerant sequentially passes through said compressor said first connecting port of said switching valve, said third connecting port of said switching valve, said front heat exchanger, said first unidirectional valve, said first filter, and said first flow regulating valve, said first pre-heating heat exchanger of said energy efficient arrangement, said rear heat exchanger, second connecting port of said switching valve, said fourth connecting port of said switching valve, and back to said compressor.

15. The air conditioning and heat pump tower, as recited in claim 14, wherein said energy efficient arrangement further comprises a second pre-heating heat exchanger connected in series to said first pre-heating heat exchanger, said refrigerant leaving said front heat exchanger being guided to sequentially pass through said second pre-heating heat exchanger and said first pre-heating heat exchanger.

16. The air conditioning and heat pump tower, as recited in claim 15, further comprising a second flow regulating valve connected between said first pre-heating heat exchanger and said second pre-heating heat exchanger.

17. The air conditioning and heat pump tower, as recited in claim 16, wherein said first pre-heating heat exchanger and said second pre-heating heat exchanger being positioned between said outdoor air intake opening and outdoor heat exchanging portion of said front heat exchanger in such a manner that ambient air drawn from said outdoor air intake opening is arranged to sequentially pass through said first pre-heating heat exchanger, said second pre-heating heat exchanger and said outdoor heat exchanging portion.

18. The air conditioning and heat pump tower, as recited in claim 17, wherein when in said heat pump mode, said air conditioning and heat pump tower is configured such that said refrigerant sequentially passes through said compressor said first connecting port of said switching valve, said third connecting port of said switching valve, said front heat exchanger, said first unidirectional valve, said first filter, said first flow regulating valve, said second pre-heating heat exchanger of said energy efficient arrangement, said first pre-heating heat exchanger of said energy efficient arrangement, said rear heat exchanger, second connecting port of said switching valve, said fourth connecting port of said switching valve, and back to said compressor.

19. An air conditioning and heat pump tower being positioned at an opening of a wall which creates an indoor space and an outdoor space on two sides of said wall, said air conditioning and heat pump tower comprising:

a main casing comprising a partitioning wall, and having:

an indoor portion exposed to said indoor space;

an outdoor portion exposed to said outdoor space;

a receiving cavity formed in said main casing, said partitioning wall dividing said receiving cavity into a front compartment and a rear compartment;

an indoor air inlet being formed on said indoor portion of said main casing, and communicating said front compartment with said indoor space;

an indoor air outlet being formed on said indoor portion of said main casing, and communicating said front compartment with said indoor space;

an outdoor air inlet being formed on said outdoor portion of said main casing, and communicating said rear compartment with said outdoor space;

an outdoor air outlet being formed on said outdoor portion of said main casing, and communicating said rear compartment with said outdoor space; and at least one outdoor air intake opening being formed on said outdoor portion of said main casing, and communicating said front compartment with said outdoor space, said main casing further comprising an external casing, a supporting casing slidably connected to said external casing, and a plurality of wheels connected to said supporting casing;

a plurality of connecting pipes received in said receiving cavity of said main casing;

a compressor supported in said main casing, said compressor having a compressor outlet and a compressor inlet;

a front heat exchanger supported in said front compartment of said main casing and connected to said compressor through at least one of said connecting pipes, said front heat exchanger has an indoor heat exchanging portion extending in said indoor portion of said main casing, and an outdoor heat exchanging portion extending in said outdoor portion of said main casing; and a rear heat exchanger supported in said rear compartment of said main casing and connected to said compressor and said front heat exchanger through at least one of said connecting pipes;

a fan supported in said main casing for drawing air to flow between said indoor space and said outdoor space; and an energy efficient arrangement, which comprises:

a first pre-heating heat exchanger supported in said front compartment of said receiving cavity at an outdoor portion of said main casing, said first pre-heating heat exchanger being positioned between said air intake opening and said outdoor heat exchanging portion of said front heat exchanger and connected between said front heat exchanger and said rear heat exchanger;

said air conditioning and heat pump tower being selectively operated between an air conditioning mode and a heat pump mode, wherein in said air conditioning mode, a predetermined amount of vaporous refrigerant is arranged to leave said compressor and guided to enter said rear heat exchanger for releasing heat to ambient atmosphere, said refrigerant leaving said rear heat exchanger being guided to flow into said front heat exchanger for absorbing heat from said indoor space, said refrigerant leaving said front heat exchanger being guided to flow back to said compressor to complete an air conditioning cycle, wherein in said heat pump mode, a predetermined amount of vaporous refrigerant is arranged to leave said compressor and guided to flow into said front heat exchanger for releasing heat to said indoor space, said refrigerant leaving said front heat exchanger being guided to flow into said first pre-heating heat exchanger for releasing heat to ambient air drawn from said outdoor air intake opening, said refrigerant leaving said first pre-heating heat exchanger being guided to flow into said rear heat exchanger for absorbing heat from ambient air drawn from said outdoor air inlet, said refrigerant leaving said rear heat exchanger being guided to flow to back said compressor to complete a heat pump cycle.

20. The air conditioning and heat pump tower, as recited in claim 14, wherein said main casing comprises an external casing, a supporting casing slidably connected to said external casing, and a plurality of wheels connected to said supporting casing.

21. The air conditioning and heat pump tower, as recited in claim 18, wherein said main casing comprises an external casing, a supporting casing slidably connected to said external casing, and a plurality of wheels connected to said supporting casing.

* * * * *